US006224427B1

(12) United States Patent
Goodrich

(10) Patent No.: US 6,224,427 B1
(45) Date of Patent: May 1, 2001

(54) MODULAR JACK HAVING A PLUG-POSITIONING MEMBER

(75) Inventor: Robert Ray Goodrich, Indianapolis, IN (US)

(73) Assignee: Avaya Technology Corp., Basking Ridge, NJ (US)

( * ) Notice: Subject to any disclaimer, the term of this patent is extended or adjusted under 35 U.S.C. 154(b) by 0 days.

(21) Appl. No.: 09/465,178

(22) Filed: Dec. 15, 1999

(51) Int. Cl.[7] ..... H01R 24/00
(52) U.S. Cl. ..... 439/676; 439/941
(58) Field of Search ..... 439/676, 941, 439/344, 418

(56) References Cited

U.S. PATENT DOCUMENTS

| | | | | |
|---|---|---|---|---|
| 4,497,526 | * | 2/1985 | Myers | 439/676 |
| 5,041,018 | | 8/1991 | Arnett | 439/557 |
| 5,096,442 | | 3/1992 | Arnett et al. | 439/676 |
| 5,186,647 | | 2/1993 | Denkmann et al. | 439/395 |
| 5,679,013 | * | 10/1997 | Matsunaga et al. | 439/676 |
| 5,938,480 | * | 8/1999 | Aldous et al. | 439/676 |
| 5,947,772 | * | 9/1999 | Arnett et al. | 439/676 |
| 5,997,358 | | 12/1999 | Adriaenssens et al. | 439/676 |
| 6,012,953 | * | 1/2000 | Francis | 439/676 |
| 6,095,851 | * | 8/2000 | Laity et al. | 439/676 |

* cited by examiner

*Primary Examiner*—Paula Bradley
*Assistant Examiner*—Tho D. Ta
(74) *Attorney, Agent, or Firm*—Michael A. Morra; Thomas J. Bean

(57) ABSTRACT

A modular jack 200 includes a jack housing 220 with an opening 225 in its front end that is adapted to receive a modular plug 100. Within the opening there are a number of jack springs 215 for making electrical contact with metallic blades 120 that are installed in the plug. Variations in the actual position 211 where the plug blades make contact with the jack springs are reduced by the inclusion of a positioning member within the housing. This is extremely important in situations where the modular plug includes crosstalk compensation, since positional variations affect the amount of crosstalk compensation needed. In one embodiment, the positioning member comprises a cam 228 that engages a flexible latch 130 on the modular plug to create an axial force "F1" that pushes the plug toward a retaining surface 229 within the housing. In another embodiment, the positioning member comprises a spring 213, other than the jack springs, that engages a rigid surface 135 on the modular plug to create an axial force "F2" that pushes the plug toward the fixed retaining surface.

13 Claims, 5 Drawing Sheets

MODULAR JACK HAVING A PLUG-POSITIONING MEMBER

TECHNICAL FIELD

This invention relates to connectors used in electrical communications and, more particularly, to the electrical and physical design of a modular jack.

BACKGROUND OF THE INVENTION

The term crosstalk was originally coined to indicate the presence in a telephone receiver of unwanted speech sounds from another telephone conversation. Of particular interest is crosstalk that is caused by signal coupling between adjacent circuits. The most common coupling is due to near-field effects and can usually be characterized by mutual inductance and direct capacitance. This is best illustrated by considering two parallel balanced transmission paths. One circuit (the disturbing circuit) is a source of signal energy that is undesirably coupled into an adjacent circuit via stray capacitance and mutual inductance. Near-end crosstalk NEXT) is crosstalk energy that travels in the opposite direction to that of the signal in the disturbing circuit, whereas far-end crosstalk is crosstalk energy that travels in the same direction as the signal in the disturbing circuit. Circuit analysis indicates that NEXT is frequency dependent and, for communication connectors, its magnitude typically increases with frequency at a 6.0 dB per octave rate NEXT is introduced within an electrical cable as a result of signal energy being coupled between nearby wires; and within an electrical connector, particularly modular plugs and jacks, as a result of signal energy being coupled between nearby conductors. NEXT is undesirable and is frequently referred to as offending crosstalk.

U.S. Pat. No. 5,096,442 discloses a modular jack whose NEXT is about 25 dB below the level of the incoming signal at 100 MHz. Such NEXT is attributable to crosstalk that is introduced by the combination of a standard modular plug with a standard modular jack such as are generally used for voice-grade communications. However, this level of crosstalk is generally too high for modern high-speed data applications.

U.S. Pat. No. 5,186,647 discloses a substantial improvement to the design of a standard modular jack by crossing the path of one of the conductors within the jack, over the path of another of the conductors within the jack to produce crosstalk of an opposite polarity. Such compensating crosstalk attempts to cancel NEXT rather than merely minimizing it by, for example, increasing the separation between conductors. This simple technique improves NEXT at 100 MHz by a startling 17 dB, thereby enabling popular modular jacks to meet Category 5 requirements specified in ANSI/EIA/TIA-568A. An example of such a modular jack is the M100 Communication Outlet, which is manufactured by Lucent Technologies Inc.

Techniques have been developed that further improve the crosstalk performance of an electrical connector so that NEXT is now more than 60 dB below the level of the incoming signal at 100 MHz. U.S. Pat. No. 5,997,358 shows such techniques. However, this level of crosstalk performance represents the very best that can be attained since crosstalk will vary according to how the plug is seated within the jack. At least one manufacturer has disposed the jack springs within the modular jack at a relatively large contact angle (about 36°) with respect to the longitudinal axis of the modular jack in order to push the modular plug into a fixed location within the jack. However, since there are many jack springs that need to make electrical contact with the blades of an inserted modular plug, large contact angles make this task difficult. Whereas large contact angles create increased pressure against the plug blades, increased pressure by some of the jack springs can preclude other spring contacts from making contact with the plug blades unless the plug blades and the jack springs are all precisely aligned. Indeed, current FCC standards recommend a relatively small contact angle (i.e., between 13 and 24 degrees) to assure that all plug blades make contact with the jack springs.

Accordingly, what the prior art appears to lack and what is now desired is a technique for assuring the consistent positioning of a modular plug within a modular jack, where the modular jack includes jack springs that are disposed at relatively small angles with respect to the longitudinal axis of the jack.

SUMMARY OF THE INVENTION

A modular jack includes a jack housing with an opening in its front end that is adapted to receive a modular plug. Within the opening there are a number of jack springs for making electrical contact with metallic blades that are installed in the plug. Variations in the actual position where the plug blades make contact with the jack springs are reduced by the inclusion of a positioning member within the jack. The positioning member engages the modular plug to create an axial force that pushes the plug toward a fixed retaining surface within the jack thereby reducing positional variation between the plug and the jack contact interface.

Reduced positional variation is particularly important in situations where the modular plug includes crosstalk compensation since positional variation affects the amount of crosstalk compensation needed.

In one illustrative embodiment, the positioning member comprises a cam that is molded into the housing and is positioned to engage a flexible latch on the modular plug. The interaction between the cam and the flexible latch creates an axial force that pushes the plug toward a fixed retaining surface within the housing. As a result, the plug is pushed into a known position within the jack.

In another illustrative embodiment, the positioning member comprises a spring, other than the jack springs, that engages a rigid surface on the modular plug to create an axial force that pushes the plug toward the fixed retaining surface. Advantageously, in both embodiments, the improved modular jack is compatible with existing modular plugs.

BRIEF DESCRIPTION OF THE DRAWING

The invention and its mode of operation will be more clearly understood from the following detailed description when read with the appended drawing in which.

DETAILED DESCRIPTION

Figure 1:
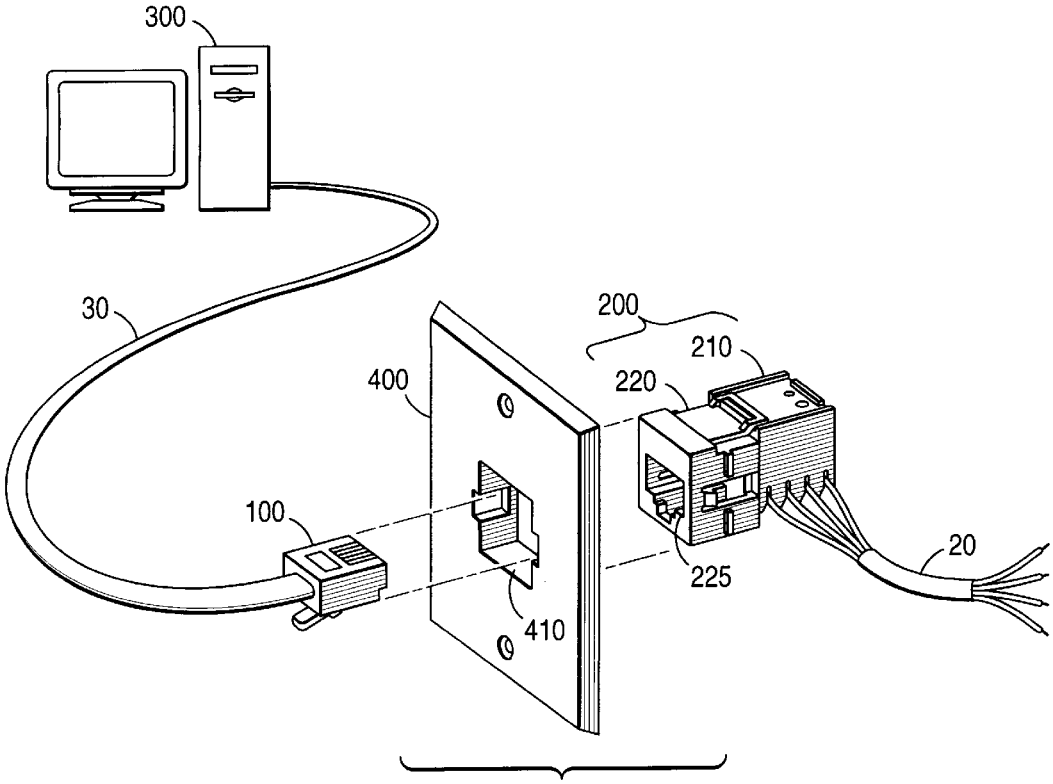
FIG. 1 shows an assembly of interconnecting hardware, which is used in an electrical communication system.

FIG. 1 discloses an assembly of interconnecting hardware, which is used in an electrical communication system. This hardware is illustratively used to interconnect a high-speed computer station 300 to an electrical cable 20 via standard telecommunications connecting apparatus such as a cord 30, a modular plug 100, and a modular jack 200. Specifications for such plugs and jacks can be found in subpart F of the FCC Part 68.500 Registration Rules. Modular jack 200 comprises a spring block assembly 210 and a jack housing 220 that interlock together to provide a convenient receptacle for receiving and holding the modular plug 100. Spring block assembly 210 includes a number of electrically conductive paths. The conductive paths terminate, at one end, in flexible wire springs (hereinafter "jack springs") that are made, for example, from a resilient material such as beryllium-copper and are arrayed within the modular jack to make electrical contact with a corresponding array of metallic blades 120 within the modular plug (see FIG. 2). The conductive paths terminate in insulation-displacement connectors, at the other end, that make electrical contact with the wires in cable 20. Examples of known spring block assemblies are shown in U.S. Pat. Nos. 5,041,018 and 5,096,442 and are designed to be installed into the back end of a jack housing 220.

An opening 225 in the front end of jack housing 220 is shaped to receive the modular plug 100, which is inserted and held therein. However, even though the modular plug is locked within the modular jack via cantilever latch 130 (see FIG. 2), its blades 120 may contact the jack springs anywhere over range of positions according to how deeply the plug is inserted. This is known as positional variation, and the present invention seeks to reduce or eliminate it. And while positional variation is not a problem for voice frequency communications, it adversely affects electrical performance at higher frequencies. A wall plate 400 is frequently used to support the modular jack 200, which is installed into an opening 410 in the wall plate that is designed to hold the jack.

Figure 2:
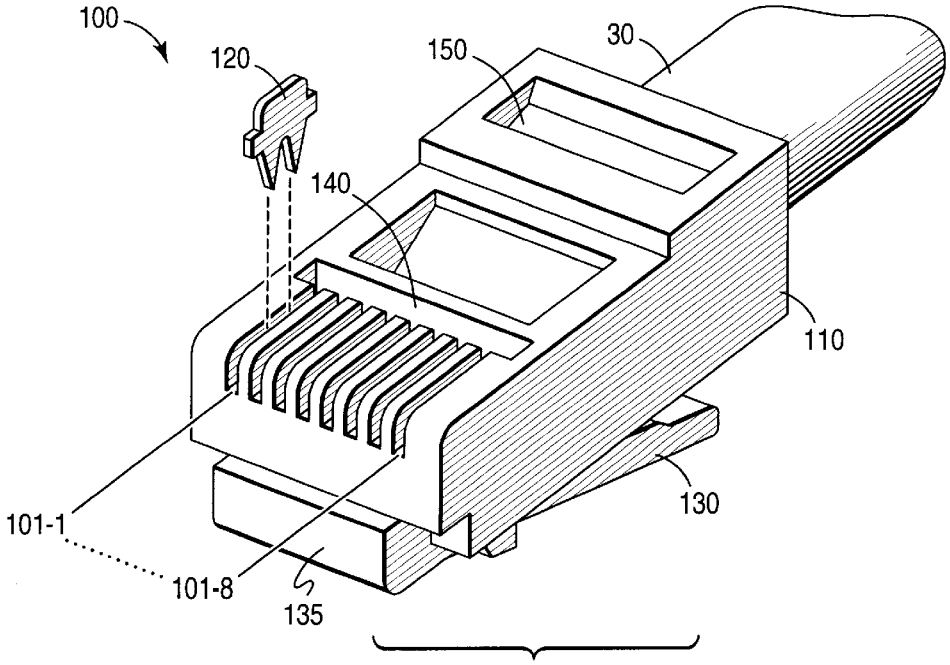
FIG. 2 is a top side perspective view of a modular plug.

FIG. 2 is a perspective view of a standard modular plug 100 illustrating its general construction. Modular plug 100 comprises a dielectric plug housing 110 having a number of metallic terminals 120, which are inserted into a plurality of terminal-receiving slots. In FIG. 2 there are eight such slots (101-1 through 101-8) that extend downward from the top side of the housing into conductor-receiving ducts that hold the wires from cord 30. Plug housing 110 includes a rigid front surface 135 and a conductor strain relief member 140, which is deflected downward during assembly to anchor the conductors in engagement with the bottom of a chamber within the plug in order to provide strain relief for the conductors. Plug housing 100 further includes a jacket strain relief member 150, which is also deflected downward during assembly in order to provide strain relief for the jacket of cord 30. A cantilever latch 130 is provided for locking the plug 100 with the modular jack 200. At this point, it is noted that the present invention deals with modifications to the modular jack that reduce axial movement of a modular plug 100 within a modular jack 200. In particular, modular jack 200 is adapted to reduce axial movement of standard modular plugs.

Near-End Crosstalk

As discussed in the Background of the Invention, crosstalk between pairs of conductors within a modular jack can be significantly reduced by adding compensating crosstalk within the jack. Compensating crosstalk has a polarity, which is opposite the polarity of the offending crosstalk, and is deliberately introduced in an attempt to cancel the offending crosstalk. Moreover, it is important that: (1) the compensating crosstalk be introduced as close as possible to the offending crosstalk; and (2) the compensating crosstalk be introduced at a consistent location within the modular jack. These considerations recognize that at high frequencies (i.e., frequencies equal to or greater than 100 MHz) the phase of the compensating crosstalk changes significantly over short distances, and it is essentially impossible to introduce compensating crosstalk that is exactly 180 degrees out of phase with the offending crosstalk because of propagation delay. This has caused designers to introduce the compensating crosstalk within the modular jack as close as possible to the location where the jack springs make contact with the blades in the modular plug; and to keep that location constant. The present invention achieves these goals as illustrated in the embodiment of FIG. 3.

Figure 3:
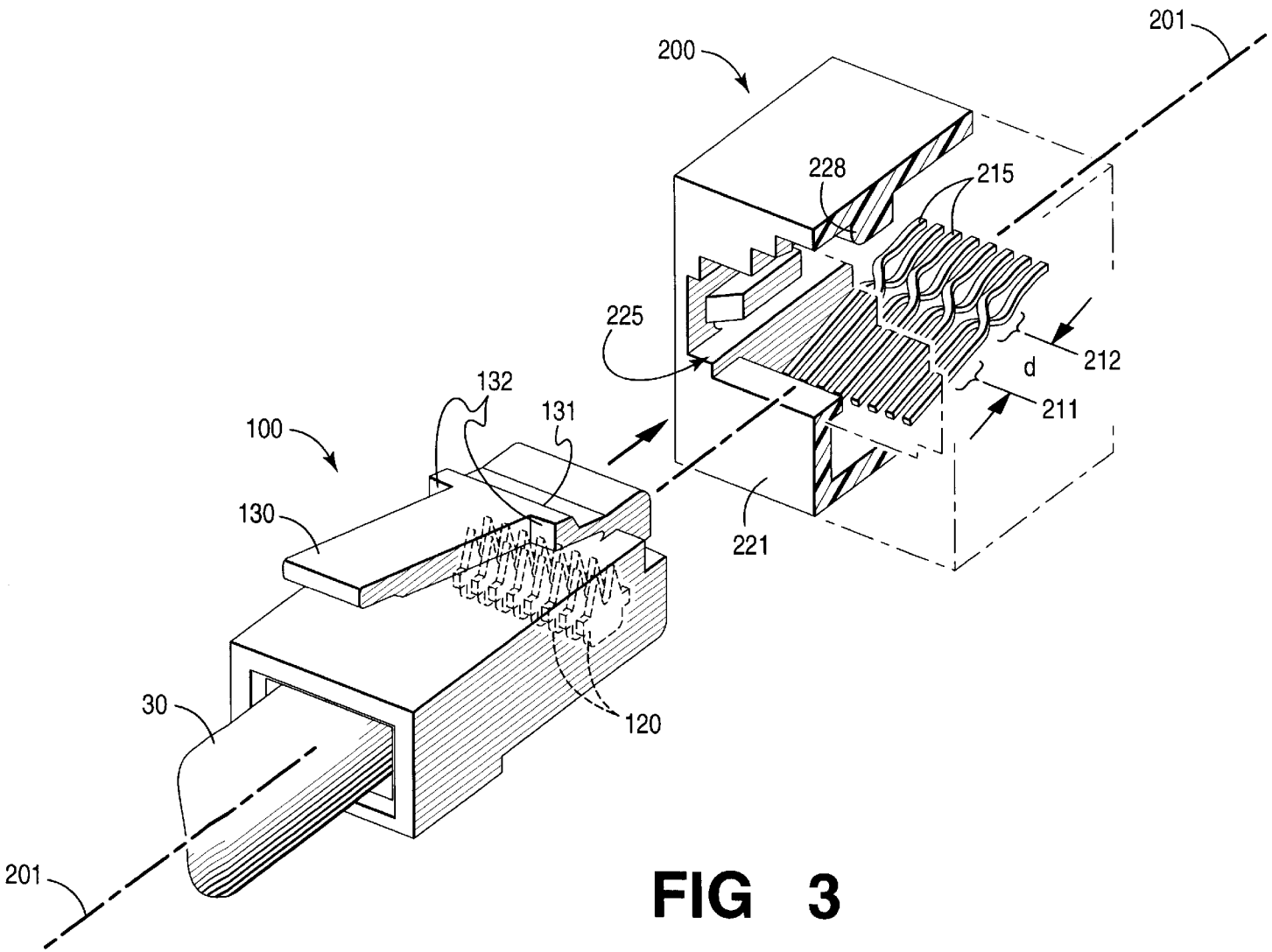
FIG. 3 is a bottom side perspective view of the modular plug being inserted into a first embodiment of a modular jack according to the present invention.

FIG. 3 is a perspective view of a modular plug 100, having a cord 30 attached thereto, that is about to be inserted into an opening 225 in the front end 221 of modular jack 200. Insertion is achieved by advancing the plug 100 along the longitudinal axis 201—201 of the jack into the opening 225. It is noted that this design provides a limited amount of plug travel "d1," which is approximately 0.033 inches (0.84 millimeters) until the plug is pushed against a back retaining surface 214. Once the plug is fully inserted into the jack 200, plug blades 120 make electrical contact with jack springs 215 in the location designated 211. It is desirable for location 211 to be close to location 212 so that offending crosstalk, which is introduced in the region between 211 and 212, is minimized. It is particularly important to know the exact distance "d" between these locations because variations in this distance change the magnitude and phase of the offending crosstalk that needs to be canceled. Thus, by reducing the variation of distance "d," the compensating crosstalk provided by the modular jack can be more accurately designed to cancel the offending crosstalk. It is noted that compensating crosstalk may be introduced by techniques other than crossing jack springs 215, and that the present invention may be used in any modular jack that would benefit from reduced variation of the location 211 where electrical contact is made between the plug blades 120 and the jack springs 215.

In accordance with the present invention, the variation of distance "d" is reduced by reducing the variation of location 211. This is accomplished by including a positioning member within the modular jack 200 that causes an inserted modular plug 100 to be consistently seated in a known position. Once the plug is inserted into the jack, it is pushed forward or backward until it encounters a retaining surface that stops further movement in that direction. In accordance with a first embodiment of the present invention shown in FIGS. 3 and 4, advantageous use is made of the flexible cantilever latch 130, which is present on all standard modular plugs, that flexes in order to allow the plug to enter an opening 225 in the front end 221 of the modular jack 200. In this embodiment the positioning member comprises a cam 228 that interacts with an angled (about 60° with respect to the longitudinal axis 201) surface 131 on the cantilever latch to create a force "F1" that tends to push the modular plug out of the jack housing 220. This force "F1" is created by the restorative force of the cantilever latch 130 as it attempts to return to its original, non-flexed state. However, the jack housing includes a forward retaining surface 229, which engages a stop surface 132 on the cantilever latch and thereby prevents the plug from becoming decoupled from the jack housing. Advantageously, the plug 100 has reduced positional variation. FCC standards for modular plugs and jacks allow for approximately 0.033 inches (0.84 millimeters) of axial positional freedom. When the jack springs 215 are disposed at an acute angle $\phi$ of 17°, for example, with respect to the longitudinal axis 201—201, then the actual variation in transmission path length "d" is approximately 0.035 inches (0.89 millimeters). Since additional offending crosstalk is introduced in the region between locations 211 and 212, whose distance "d" is approximately 0.148 inches (3.76 millimeters), then eliminating the FCC-allowed positional variation by a maximum of 0.035 inches (0.89 millimeters) (or 23%) likewise reducing the variation of the offending crosstalk in this region. And while the offending crosstalk is increased slightly owing to the direction of "F1", it can be canceled more precisely because it is precisely known.

Figure 4:
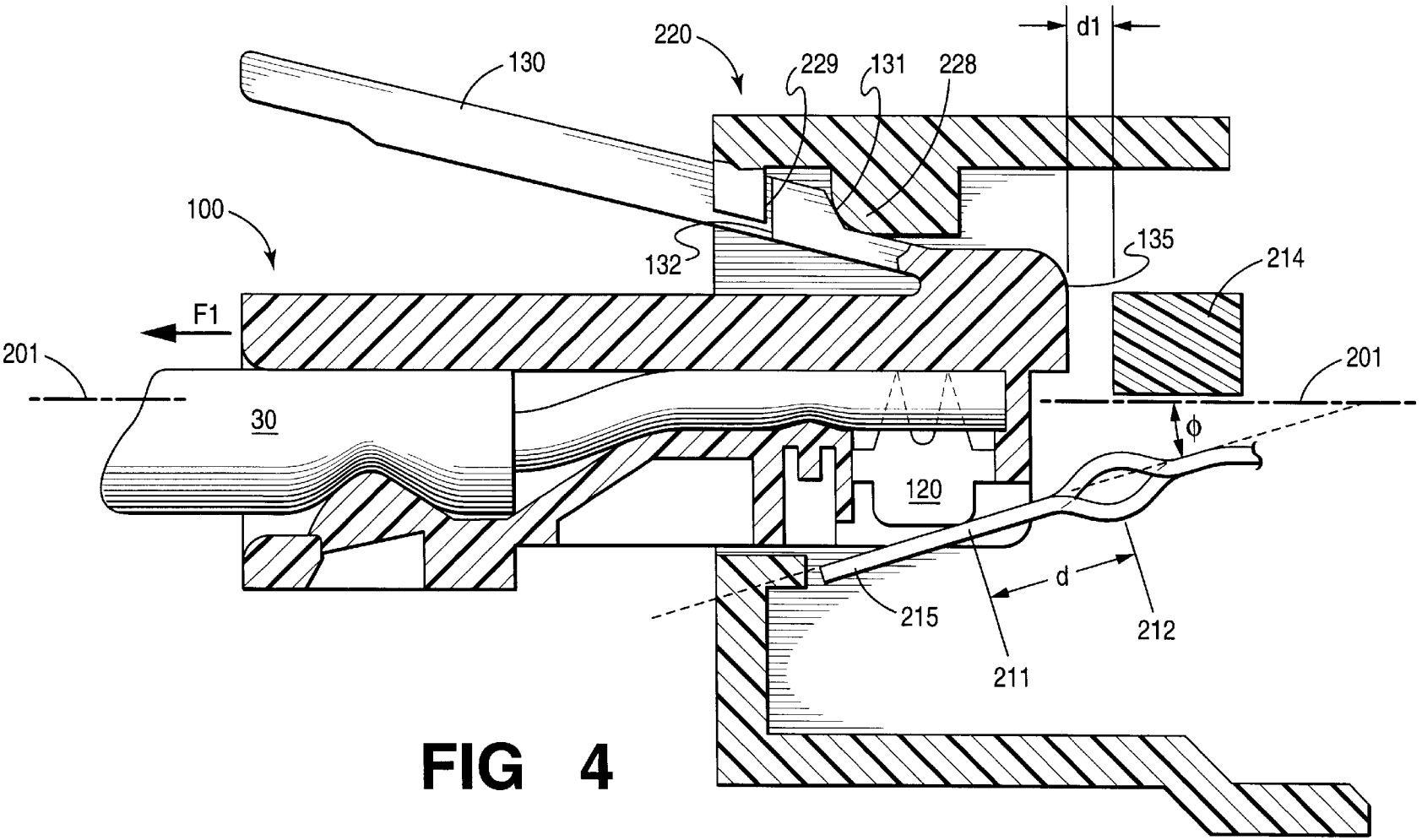
FIG. 4 shows a cross-section view of the first embodiment of the invention with the modular plug installed within the modular jack.

It is noted that FIGS. 3 and 4 do not show with any particularity how the jack springs 215 are mounted within the spring block assembly 210, such detail is relatively unimportant to the present invention and, if shown, would tend to confuse the reader. Nevertheless, now that the basic operation of one embodiment of the invention has been shown and described, a second embodiment will now be disclosed that reveals greater detail regarding the actual construction of the modular jack 200.

Figure 5:
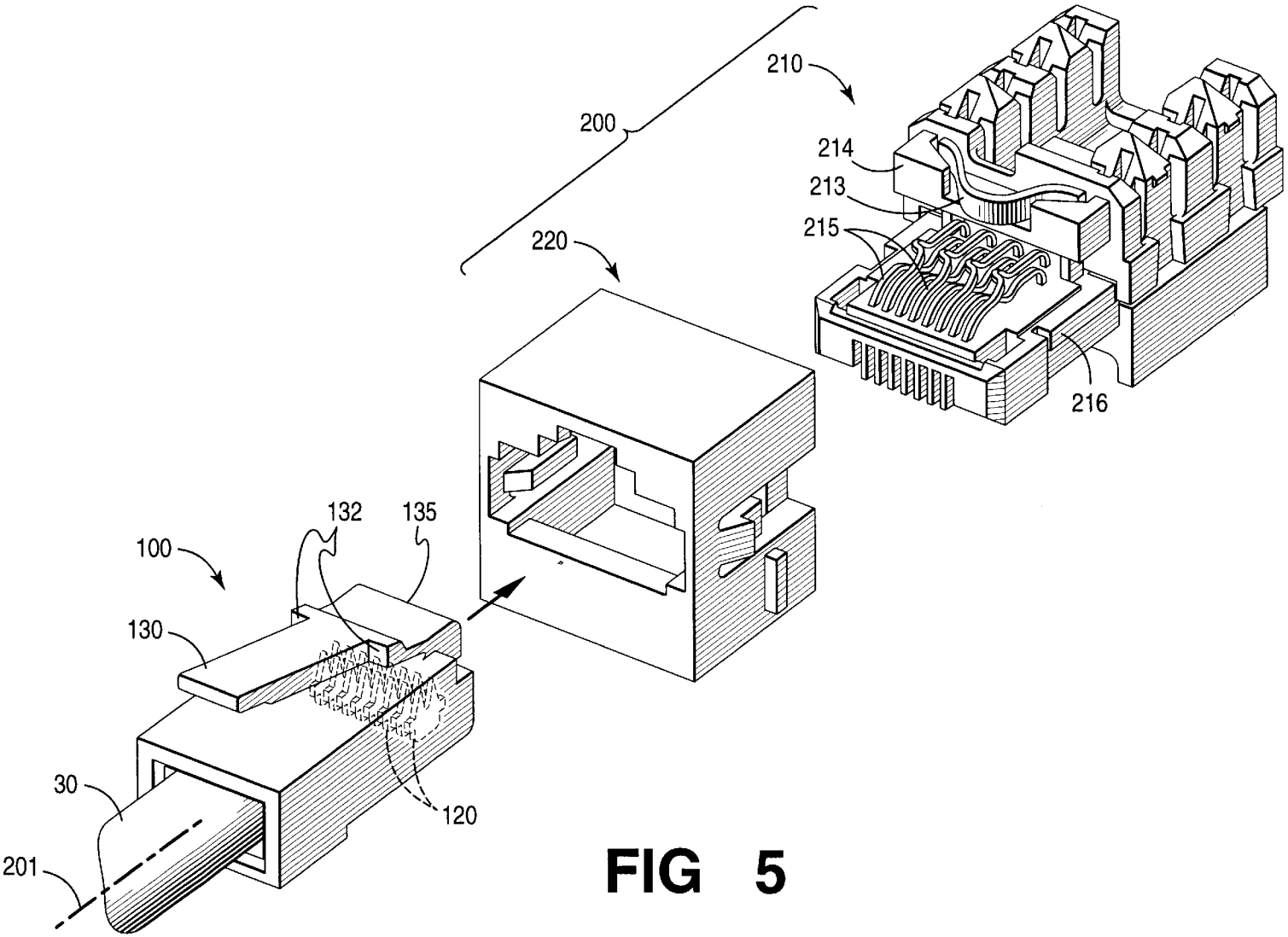
FIG. 5 is a bottom side perspective view of the modular plug being inserted into a second embodiment of a modular jack according to the present invention.
Figure 6:
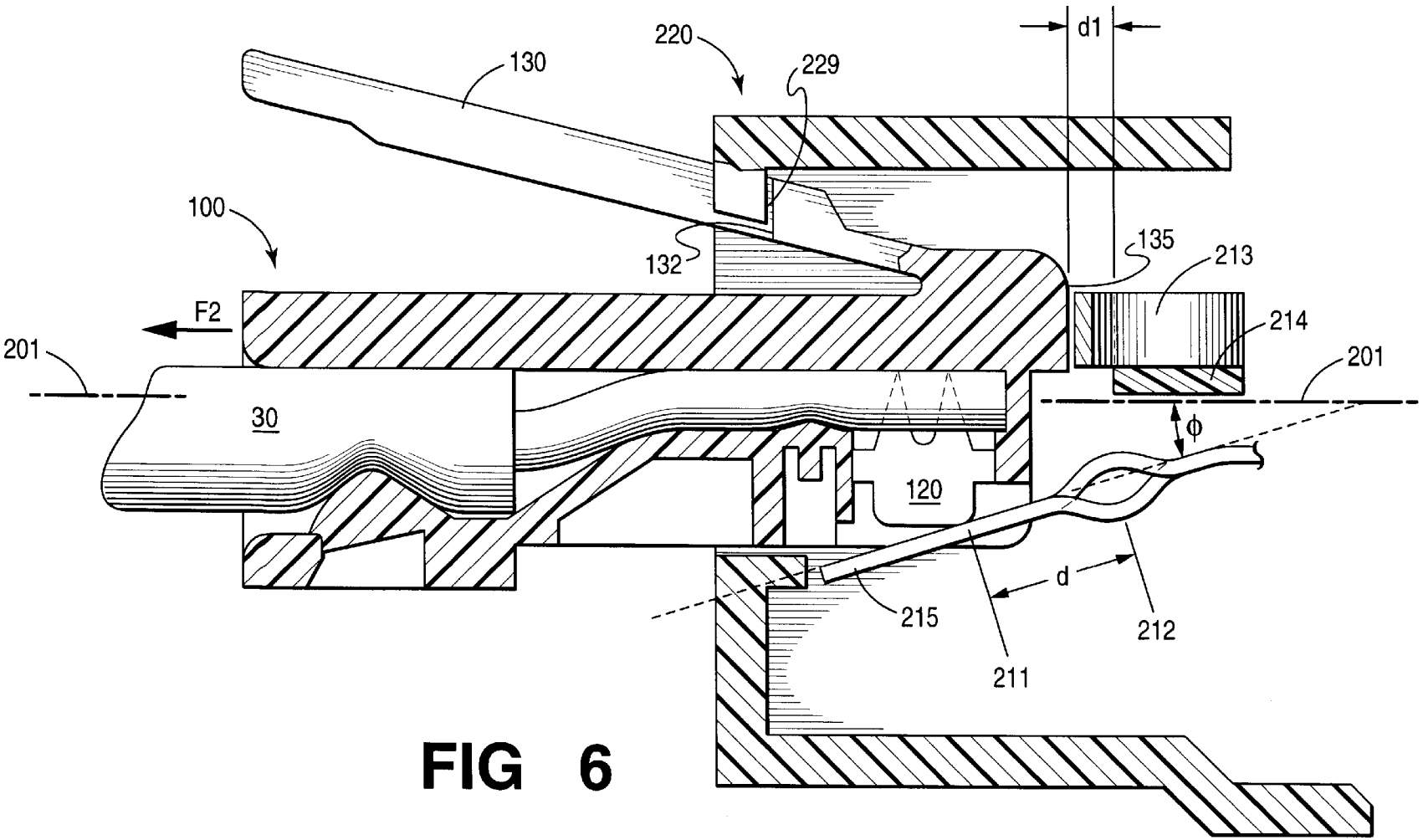
FIG. 6 shows a cross-section view of the second embodiment of the invention with the modular plug installed within the modular jack.

FIGS. 5 and 6 disclose a second embodiment of the present invention, which reveals detail regarding the construction of modular jack 200. In particular, modular jack 200 comprises a spring block assembly 210 that is installed into the back end of jack housing 220. The jack springs 215 are mounted on a structure 216 that includes circuitry for introducing capacitive and/or inductive coupling between selected pairs of conductors in order to provide compensating crosstalk as discussed above. Application Ser. No. 09/264506, which was filed on Mar. 8, 1999, provides detailed information regarding the design of spring block assembly 210 and is hereby incorporated by reference. In the second embodiment, the positioning member comprises a resilient leaf spring 213, illustratively made from a metallic material such as beryllium-copper, that is mounted in a front-end portion of the spring block assembly 210. Once the modular plug 100, the jack frame 220 and the spring block assembly 210 are joined together as shown in FIG. 6, the flexible leaf spring 213 is positioned to interact with the rigid front surface 135 of the modular plug 100 in order to create a force "F2" that tends to push the modular plug out of the jack housing 220. This force "F2" is created by the restorative force of the spring 213 as it attempts to return to its original, non-flexed state. However, the jack housing includes a forward retaining surface 229, which engages a stop surface 132 on the cantilever latch and thereby prevents the plug from becoming decoupled from the jack housing. Advantageously, the distance "d" between location 211 (where the jack springs 215 make contact with the plug blades 120) and location 212 (where crosstalk compensation is introduced) is relatively constant. Accordingly, this second embodiment also provides the desired consistent positioning of a modular plug within a modular jack.

Although various particular embodiments of the present invention have been shown and described, modifications are possible within the scope of the present invention. These modifications include, but are not limited to: the use of positioning members that force the modular plug more deeply into the modular jack; the use of multiple positioning members within the modular jack; the use of an elastomeric material such as rubber as the positioning member; and the use of materials other than those shown in this specification in the construction of the modular jack.

What is claimed is:

1. A modular jack having a longitudinal axis that extends between front and back ends thereof, the front end having an opening within the jack that is shaped to receive a modular plug, the opening including a retaining surface that precludes movement of the plug in an axial direction toward the opening after the plug is installed in the opening, said jack including a plurality of jack springs that are disposed within the opening at acute angles with respect to the longitudinal axis and are positioned to make electrical contact with a plurality of metallic blades that are contained within the modular plug,

CHARACTERIZED IN THAT the modular jack further includes a positioning member comprising a substantially rigid cam that is positioned to engage and displace a flexible member on the modular plug after the modular plug is installed in the opening in order to generate a restorative force that causes the modular plug to move axially toward the retaining surface, thereby reducing positional variation in the axial direction between the plug and jack.

2. The modular jack of claim 1 wherein the modular jack further includes apparatus for providing crosstalk compensation.

3. The modular jack of claim 1 wherein the positioning member is arranged to cause axial movement of the modular plug from the back end of the housing toward the front end thereof.

4. The modular jack of claim 1 wherein the flexible member on the modular plug comprises a cantilever latch.

5. The modular jack of claim 1 wherein the jack springs all disposed at angles within the range between 13 and 24 degrees.

6. The modular jack of claim 5 wherein all of the jack springs are disposed at substantially the same angle.

7. In combination, a modular plug comprising a dielectric housing member having a front end, a top side and a bottom side, the plug further comprising a plurality of metallic blades that are installed in the top side of the dielectric housing member and a flexible cantilever latch that is positioned on the bottom side of the dielectric housing member; and a modular jack having a longitudinal axis that extends between front and back ends thereof, the front end having an opening that is shaped to receive the modular plug, the opening including a retaining surface that precludes movement of the plug in an axial direction toward the opening after the plug is installed in the opening, said jack including a plurality of jack springs that are disposed within the opening at acute angles with respect to the longitudinal axis and are positioned to make electrical contact with the plurality of metallic blades,

CHARACTERIZED IN THAT the modular jack further includes a positioning member comprising a substantially rigid cam that is positioned to engage and displace a flexible region of the flexible cantilever latch after the modular plug is installed in the opening in order to generate a restorative force that causes the modular plug to move axially toward the retaining surface, thereby reducing positional variation in the axial direction between the modular plus and jack.

8. The combination of claim 7 further including an electrical cord containing a plurality of insulated wires, which are attached to the plurality of metallic blades.

9. The combination of claim 7 wherein the positioning member is arranged to cause axial movement of the modular plug from the back end of the housing toward the front end thereof.

10. A modular plug comprising a dielectric housing member having a front end, a top side and a bottom side, the plug further comprising a plurality of metallic blades that are installed in the top side of the dielectric housing member and a flexible cantilever latch that is positioned on the bottom side of the housing; and a modular jack having a longitudinal axis that extends between front and back ends thereof, the front end having an opening that is shaped to receive the modular plug, the opening including a retaining surface that precludes movement of the plug in an axial direction toward the opening after the plug is installed in the opening, said jack including a plurality of jack springs that are disposed within the opening at acute angles with respect to the longitudinal axis and are positioned to make electrical contact with the plurality of metallic blades,

CHARACTERIZED IN THAT said jack further includes a jack housing having front and back ends, and a spring block assembly, which is installed in the back end of the housing, said spring block assembly including circuitry for introducing a compensating crosstalk signal between selected conductors within the jack, the polarity of said compensating crosstalk signal being opposite in sign to the polarity of an offending crosstalk signal, which is generated within the modular plug, the modular jack further including a positioning member other than the jack springs, generating a restorative force that causes the modular plug to move axially toward the retaining surface, wherein the positioning member is mounted on the spring block assembly at a location that enables it to engage the modular plug after the plug is installed in the front end of the jack housing and the spring block assembly is installed in the back end of the jack housing.

11. The combination of claim 10 wherein the positioning member comprises a metallic leaf spring.

12. A modular jack having a longitudinal axis that extends between front and back ends thereof, the front end having an opening within the jack that is shaped to receive a modular plug, the opening including a retaining surface that precludes movement of the plug in an axial direction toward the opening after the plug is installed in the opening, said jack including a plurality of jack springs that are disposed within the opening at acute angles with respect to the longitudinal axis and are positioned to make electrical contact with a plurality of metallic blades that are contained within the modular plug,

CHARACTERIZED IN THAT the modular jack further includes a housing and a positioning member, wherein the positioning member is flexible and is mounted on a spring block assembly installed in a back end of the housing, said spring block assembly including circuitry for introducing a compensating crosstalk signal between selected conductors within the jack, the polarity of said compensating crosstalk signal being opposite in sign to the polarity of an offending crosstalk signal which is generated within the modular plug, said positioning member being at a location that enables it to engage the modular plug after the plug is installed in a front end of the jack housing and the spring block assembly is installed in the back end of the jack housing, said positioning member causing the modular plug to move axially toward the retaining surface in order to reducing positional variation in the axial direction between the plug and jack.

13. The modular jack of claim 12 wherein the positioning member comprises a leaf spring.

* * * * *